United States Patent [19]

Chu

[11] 4,152,158

[45] May 1, 1979

[54] ELECTROCHEMICALLY TREATED PHOTO-LITHOGRAPHIC PLATES

[75] Inventor: Simon L. Chu, Dobbs Ferry, N.Y.

[73] Assignee: Polychrome Corporation, Yonkers, N.Y.

[21] Appl. No.: 853,170

[22] Filed: Nov. 21, 1977

Related U.S. Application Data

[63] Continuation of Ser. No. 619,743, Oct. 6, 1975, abandoned, which is a continuation of Ser. No. 459,595, Apr. 10, 1974, abandoned, which is a continuation of Ser. No. 187,854, Oct. 8, 1971, abandoned, which is a continuation of Ser. No. 715,568, Mar. 25, 1968, abandoned.

[51] Int. Cl.[2] ..... G03C 1/94; C23F 7/00; C25D 11/12

[52] U.S. Cl. ..... 96/75; 96/33; 96/86 P; 148/6.27; 204/33; 204/38 A; 204/42

[58] Field of Search ..... 96/33, 75, 86 P; 148/6.27; 204/33, 38 A, 42

[56] References Cited

U.S. PATENT DOCUMENTS

| | | | |
|---|---|---|---|
| 2,126,017 | 8/1938 | Jenny et al. | 96/86 R |
| 3,136,639 | 6/1964 | Deal et al. | 96/33 |
| 3,181,461 | 5/1965 | Fromson | 96/33 |
| 3,280,734 | 10/1966 | Fromson | 96/33 |
| 3,330,743 | 7/1967 | Jestl et al. | 96/86 R |
| 3,440,050 | 4/1969 | Chu | 96/75 |

*Primary Examiner*—Charles L. Bowers, Jr.

[57] ABSTRACT

There are disclosed herein lithographic plates having an aluminum base the surface of which has been made porous and hardened first by an alternating current anodization in a hydrochloric acid electrolyte and then by a direct current anodization in a sulfuric acid electrolyte.

6 Claims, No Drawings

ELECTROCHEMICALLY TREATED PHOTO-LITHOGRAPHIC PLATES

CROSS REFERENCE TO RELATED APPLICATIONS

This Application is a continuation of copending application Ser. No. 619,743 filed on Oct. 6, 1975, now abandoned which was a continuation of Ser. No. 459,595 filed on Apr. 10, 1974, now abandoned, which was a continuation of Ser. No. 187,854 filed Oct. 8, 1971 now abandoned, which was a continuation of Ser. No. 715,568 filed on Mar. 25, 1968, now abandoned.

This invention relates to sheet materials useful for photochemical processes, such as the preparation of lithographic plates, and more particularly to sheet materials that comprise an aluminum base having overcoats of a light-sensitive material, such as the various diazo compounds known to the lithograhic art.

The art of lithographic printing depends upon the immiscibility of grease and water, upon the preferential retention of a greasy image-forming substance by an image area, and upon the similar retention of an aqueous dampening fluid by a non-image area. When a greasy image is imprinted upon a suitable surface and the entire surface is then mositened with an aqueous solution, the image area will repel the water and the non-image area will retain the water. Upon subsequent application of greasy ink, the image portion retains ink whereas the moistened non-image area repels it. The ink on the image area is then transferred to the surface of a material on which the image is to be reproduced, such as paper, cloth and the like, via an intermediary, a so-called offset or blanket cylinder, which is necessary to prevent mirror-image printing.

The type of lithographic plate to which the present invention is directed has a coating of a light-sensitive substance that is adherent to an aluminum base sheet. If the light-sensitive coating is applied to the base sheet by the manufacturer, the plate is referred to as a "presensitized plate." If the light-sensitive substance is applied to the base by the lithographer or trade platemaker, the plate is referred to as a "wipe-on" plate. Depending upon the nature of the photosensitive coating employed, the treated plate may be utilized to reproduce directly the image to which it is exposed, in which case it is termed a positive-acting plate, or to produce an image complementary to the one to which it is exposed, in which case it is termed a negative-acting plate. In either case the image area of the developed plate is oleophilic and the non-image area is hydrophilic.

In the case of a negative plate that is exposed to light through a negative transparency, the light-sensitive material, commonly a diazo compound, is caused to harden and thereby become insoluvble in a desensitizing solution applied to the plates after light exposure for the purpose of removing that part of the light-sensitive coating which, because it was protected from the light by the negative, was not light-hardened. The light-hardened surface of a negative plate will be the oleophilic surface compatible with the greasy ink and is called the "image area"; the surface from which the non-hardened light-sensitive material has been removed by a desensitizer will be, or can be converted to, a hydrophilic surface having little affinity for the greasy ink and is called the "non-image" area.

A positive plate is generally one-upon which the non-image area is the portion of the light-sensitive diazo compound exposed to light while the unexposed portion is either oleophilic or adapted to be converted by chemical reaction to a hardened oleophilic ink-receptive image area.

In coating a metallic plate with a light-senstive material, however, it is highly desirable initially to provide the metal with a hydrophilic surface to which the light-sensitive coating adheres and which becomes the ink-repulsive non-image area upon removal of the unconverted, unhardened light-sensitive material. It is known to produce such hydrophilic surfaces on metallic plates for planographic printing purposes by various procedures.

It has been a problem in the art to provide a treatment for metallic plates that would cause a metallic plate to be strongly bonded to a subsequently applied light-sensitive compound so that very large numbers of prints, e.g., in excess of 100,000 prints, can be obtained consistently from relatively inexpensive lithographic plates. Some of the treatments known to the art by which aluminum base sheets have been made more receptive and adherent to light-sensitive overcoats include sand blasting, brush-graining, chemical etching and marbleing the plate surface.

Anodizing aluminum by use of alternating current has also been proposed in the prior art. Anodizing the surface of the metal base sheet material of a lithographic plate, especially an aluminum sheet, provides certain advantages. Aluminum and other common photographic and lithographic base sheet metals are relatively soft and do not have high resistance to abrasion and corrosion. The oxides of such metals, such as formed on the surface by anodizing, however, in general are harder and more resistant to abrasion, wear and corrosion. Additionally, such oxidized surfaces tend to have as good or better hydrophilic and oleophobic characteristics, both of which are highly desirable in lithographic printing plates, than the unanodized metal surfaces. Plates having anodized aluminum bases are useful for direct imaging, for example, applying the oleophilic image area from a typewriter ribbon. As a base for a light-sensitive coating, such as an albumin dichromate or lithographic diazo, however, such anodized sheets are useful generally only for relatively short press runs or for line work but are not commercially acceptable for use in the printing industry to provide good quality prints over long press runs. That is particularly true for presensitized lithographic plates. To remedy the deficiencies of anodized aluminum plates, light-sensitive cinnamyl derivatives have been used in conjunction with the anodized aluminum plate surface. Such plates, however, are very expensive and extraordinary care must be taken to prepare and process the plates.

Therefore, until recently in order to insure runs of over 100,000 lithographic copies, a printer generally had to use deep-etch type plates or the equivalent. In runs of up to about 250,000 copies, standard deep-etch type plates of either zinc or aluminum have been used. Such plates are far more expensive to produce than the novel plates described in the instant application. Furthermore, the processing steps required to prepare such plates in the print shop require time and the skill of a trained, experienced worker.

One method of producing commercially acceptable, storage stable presensitized lithographic plates having good shelf-life is disclosed in U.S. Pat. No. 3,440,050. According to that method, an aluminum sheet is anodized with an alternating current in a hydrochloric acid bath. The anodized surface is then treated with a zirconium fluoride or equivalent type salt or acid to form a hydrophilic reaction product with the anodized surface of the aluminum sheet. An overcoated lithographic diazo strongly adhers to the anodized and treated surface. Such plates provide excellent quality copies in press runs of up to 250,000 copies and are the first low-cost, easy to process, presenitized anodized aluminum lithographic plates capable of giving such long printing runs.

It is an object of the present invention to provide an improved sheet useful for receiving a light-sensitive coating to form an exceptionally durable lithographic plate. It is a further object of this invention to provide a lithographic plate that is useful for exceptionally long press runs. Another object of the invention is to provide a means for producing presensitized anodized aluminum lithographic plates that are storage stable, strongly adherent to the diazo image areas thereon, have very hard, wear-resistant but fine surfaces, and thus provide exceptionally long press runs of high quality copies. These and other objects of this invention will be in part discussed and in part apparent from the more detailed disclosure herein after.

It has been found that lithographic plates fulfilling the foregoing objectives can be produced by anodizing an aluminum base sheet with alternating current in a hydrochloride acid bath and thereafter anodizing the sheet with direct current in a sulfuric acid bath. The aluminum sheet thus anodized then can be coated with a light-sensitive material, such as a diazo or other material known and commonly used in the lithographic art. Surface treatments of the anodized surface prior to applying the light-sensitive coating, for example, treatment with a zirconium fluoride or equivalent salt or acid, a water-soluble alkali solicate or silicic acid, or other lithographically desirable intermediate-forming substances known in the art, also can be utilized to advantage in making plates according to this invention.

Although generally all light-sensitive coatings used with aluminum base sheets in the lithographic art presently appear to be suitable for use with sheets anodized according to this invention, diazo-containing coatings are preferred. Such coatings can be a diazo compound in a tannable colloid, e.g., albumin, or in an organic hydrophilic water-soluble film-forming resin hardenable by the light-reacted diazo, e.g., vinyl polymers such as polyacrylamide or hydroxyalkyl ethers of cellulose. Alternatively, the diazo can be in a resinous form, for example, the condensation product of para-diazodiphenylamine and paraformaldehyde as disclosed in U.S. Pat. No. 2,946,683. Exceptional results have been obtained with plates coated with the reaction products of such diazo condensation products and certain coupling agents therefor, as disclosed in U.S. Pat. No. 3,300,309, and thus those diazo reaction products at this time are most preferred. Other light-sensitive diazo reaction products, for example, the reaction product of a diazonium compound and potassium ferrocyanide as disclosed in U.S. Pat. No. 3,113,023 and azides, are also suitable.

The aluminum used as the base sheet is preferably 99% or more pure. Aluminum alloys, for example, the No. 1100 or No. 1145 alloys, also are suitable. Purer alloys than those two types do not presently appear to have any advantage because they tend to have less mechanical strength and to be higher in cost.

It is usually necessary to degrease the aluminum sheet prior to anodizing it. The initial anodizing is carried out in an electrolyte which advantageously is about 0.5 to about a 2.0% solution of hydrochloride acid. The temperature of the anodizing bath is usually maintained at between about 15° C. and about 35° C. The time of anodization is desirably between about 5 to about 20 minutes at about 6 to about 14 volts, alternating current. The spacing of the plates in the bath is conveniently from about 1.5 to about 4.0 inches apart. It will be understood by those skilled in the art that the time required for the anodization process will be reduced as the acid temperature is increased or as the voltage is increased. The plates thus anodized have a dull, lustrous, whitish, matte finish.

After the initial anodizing, the aluminum sheets desirably are rinsed and any remaining acid can be neutralized in a dilute alkaline solution, e.g., an ammoniacal solution of about 1% stength.

The initially anodized sheets are then further anodized with direct current in a sulfuric acid bath. The sheets are the anodes in an anodizing tank in which sulfuric acid is the preferred electrolytic medium. The sulfuric acid solution strength preferably is in the order of about 15% by weight of acid in water, but can vary within a wider range, for example, between about 8% and about 22%, depending largely on practical and economic considerations. The electrolyte temperature does not appear to be critical, although at or slightly higher than ordinary room temperature seems to be sufficient and practically desirable. Agitation of the electrolyte, for example, by a flow of air through it, also is desirable. Good results can be obtained using a voltage in the anodizing system of about 14 to about 15 volts, although a wider range of voltage can be used, e.g., from about 10 to about 20 volts. Preferably the area of the anodic sheet surface should be about the same as the surface area of the cathode. The latter surface can be a lead-lined tank or a lead coil which can also serve, along with air agitation, to cool the electrolytic solution. A fiberglass tank can be used. A direct current density of about 15 amperes per square foot of work is desirable, although the current density also may vary within a wider range, for example, from about 10 to about 20 amperes per square foot. The anodizing time will vary depending on the foregoing factors. At the presently preferred conditions, i.e., about 15% sulfuric acid concentration, about 15 volts direct current, about 20° to about 25° C. and about 15 amperes per square foot current density, good direct anodizing current of the aluminum sheets is obtained in about 1 to about 5 minutes, generally in about 2 minutes.

Because only one side of the sheet ordinarily is used as a lithographic surface, it is efficient to anodize two sheets simultaneously by tightly clamping them together so they act as a single pole and only their outer exposed surfaces are anodized. After being anodized, the plates are rinsed, for example in cold water, for a brief period of time. Mild neutralizing solutions can also be used, if desired, prior to rinsing the plates, e.g., in an ammoniacal solution of about 1% strength.

The surfaces of the plates thus prepared have a metallic oxide coating that is very hard, abrasion resistant and porous. The initial AC anodizing of the aluminum provides a thin, porous, hardened surface on the sheet which the subsequent DC anodizing enhances. The latter treatment appears to make additional, smaller pores in the already porous surface, leaving a surface uniformly covered with fine openings and configurations with which the overcoated light-sensitive material can form strong mechanical bonds. In addition, the second anodizing further hardens the surface, thereby providing even greater wear and abrasion resistance during use. The plates do not, however, have the dark, steel-gray, lusterless appearance of mechanically pregrained and direct current anodized aluminum plates.

Because of the porous nature of anodized metal surfaces, such as the aluminum oxide on an anodized aluminum plate, it is common in the art to seal at least partially the anodized surface with various kinds of fillers that enter into the oxide coating and are retained therein, either or both chemically by reaction with the metal oxide or mechanically. Sealing is generally accomplished at elevated temperatures, at or near the boiling point of the sealing solution which can be simply water. With the anodized plates of this invention, however, it unexpectedly has been found that sealing the anodized surface with fillers and the like generally is unnecessary, and the plates can be sold as wipe-ons to which a light-sensitive coating is directly applied.

On the other hand, it is desirable to treat the anodized surface, which is to receive the coating of a light-sensitive material, with an undercoating substance that forms a strong bond with the base sheet material and with the light-sensitive coating material. Many such undercoating treatments are known in the art and commonly used for longer-running lithographic plates, and can be used on the sheets of this invention. U.S. Pat. Nos. 3,160,506, 3,136,636, 2,946,683, 2,922,715 and 2,715,066 disclose a variety of suitable materials for undercoating bonding substances onto plates and methods for applying them. Alkali silicate, silicic acid, alkali zirconium fluoride and hydrofluozirconic acid solutions presently are the most important commercial bonding substances. Those materials substantially improve the bonding of the light-sensitive coating to the underlying metallic base which otherwise generally tends to have inadequate affinity for the coating. Of the various known bonding materials, the Group IV-B metal fluorides, the alkali metal salts and the acids thereof are preferred. In particular, the alkali zirconium fluorides, such as potassium zirconium hexafluoride, and hydrofluozirconic acid disclosed in U.S. Pat. Nos. 3,160,506 and 2,496,683 are especially satisfactory for preparing the present anodized aluminum bases to receive a light-sensitive coating. The precoating treatment of the anodized plates can be done according to the methods and under the conditions known in the art, as described in the above-mentioned patents, whose disclosures are specifically imcorporated herein by reference.

It presently appears that the light-sensitive compounds and compositions known in the lithographic art is being suitable for coating onto aluminum bases are suitable for use on the anodized base sheets according to this invention. Typical examples of such light-sensitive compounds and compositions include so-called tannable colloids, for example, albumin, casein, starch and synthetic film-forming resins such as polyvinyl alcohol and polyvinyl acetate that contain a dichromate sensitizer; photopolymerizable materials that are polymerized by photoinitiators such as carbonyl, organo-sulfur, peroxide and organo-halo containing compounds; diazo compounds such as diazo-benzenes, diazo-naphthalenes, diazo-aminobenzenes, diazo-diphenylamines and diazo-mercaptobenzenes; aromatic diazido compounds such as diazido-diphenylmethane carboxylic acids, azidostyrylketones, benzoquinone diazides, naphthoquinone diazides and resin-like esters of sulfonic acids of the latter with phenolformaldehyde or acetone-pyrogallol condensation products; acenaphthenes; sulfanilidomethylene-fluorenes; S-alkylthiodiarylamine perchlorates; iodo-nitrothiophenes; and nitronaphthalenes, including carboxylic and sulfonic acid derivatives.

For making presensitized lithographic plates, certain of the above-mentioned kinds of light-sensitive compounds and compositions presently are preferred. They include generally the diazo compounds, and more particularly diazo-diphenylamine, substituted diazo-diphenylamine, condensation products of diazo-diphenylamines with compounds having reactive carbonyl groups, such as formaldehyde and paraformaldehyde, and unresinified light-sensitive reaction products of diazo-diphenylamine or condensation products thereof with hydroxyl-containing aromatic coupling agents; esters of diazo-naphthol sulfonic acids with condensation products of pyrogallol and acetone; and condensation products of quinone-(1,2)-diazie sulfonic acid halides with phenol-formaldehyde resins.

It is of course to be understood that the foregoing disclosure is intended to illustrate the invention and that numerous changes can be made in the ingredients, conditions and proportions set forth without departing from the scope of the invention as disclosed and defined in the claims appended hereafter.

I claim:

1. A sheet adapted to form a lithographic printing plate by receiving a coating of a light-sensitive compound, by exposure of said coating to light and by development of said coating, which comprises a sheet of aluminum having a porous and hardened surface, said porous and hardened surface being formed by first anodizing a surface of said aluminum sheet with alternating current at about 6 to about 14 volts for about 5 to about 20 minutes in an electrolyte of hydrochloric acid of about 0.5% to about 2.0% strength by weight at about 15 degrees C. to about 35 degrees C., and then anodizing said surface of said aluminum sheet with direct current at about 10 to about 20 volts for about 1 to about 5 minutes in an electrolyte of sulfuric acid of about 8% to about 22% strength by weight at about 20 degrees C. to about 25 degrees C.

2. The sheet according to claim 1 further comprising a bonding coating on said porous and hardened surface which coating comprises a substance selected from the group consisting of alkali silicate, silicic acid hydrofluozirconic acid, alkali zirconium fluoride and Group IV-B metal fluoride.

3. The sheet according to claim 1 further comprising a layer on said porous and hardened surface which layer comprises a lithographically suitable light sensitive composition.

4. The sheet according to claim 2 further comprising a layer on said bonding coating which layer comprises a lithographically suitable light sensitive composition.

5. The sheet according to claim 3 wherein said light sensitive composition comprises a substance selected from the group consisting of diazo compound containing compositions, quinone diazide containing compositions, and photopolymerizable material containing compositions.

6. The sheet according to claim 4 wherein said light sensitive composition comprises a substance selected from the group consisting of diazo compound containing compositions, quinone diazide containing compositions, and photopolymerizable material containing compositions.

* * * * *